US006832705B2

(12) United States Patent
Hollander et al.

(10) Patent No.: US 6,832,705 B2
(45) Date of Patent: Dec. 21, 2004

(54) LIQUID CONTAINER WITH HANDLES

(76) Inventors: Nathan Hollander, 24 Porter Rd., West Orange, NJ (US) 07052; Ephraim Hollander, 24 Porter Rd., West Orange, NJ (US) 07052; Sarah Ariella Hollander, 24 Porter Rd., West Orange, NJ (US) 07052

( * ) Notice: Subject to any disclaimer, the term of this patent is extended or adjusted under 35 U.S.C. 154(b) by 308 days.

(21) Appl. No.: 10/247,238

(22) Filed: Sep. 19, 2002

(65) Prior Publication Data

US 2004/0056053 A1 Mar. 25, 2004

(51) Int. Cl.[7] ..... A47G 19/14
(52) U.S. Cl. ..... 222/465.1; 222/466
(58) Field of Search ..... 222/465.1, 466

(56) References Cited

U.S. PATENT DOCUMENTS 1,331,409 A * 2/1920 Barnett ..... 222/466
4,805,808 A * 2/1989 Larson ..... 222/185.1
4,923,098 A * 5/1990 Schoonover et al. ..... 222/465.1

* cited by examiner

*Primary Examiner*—Philippe Derakshani
(74) *Attorney, Agent, or Firm*—Henry I. Schanzer

(57) ABSTRACT

A container embodying the invention includes a first recess formed in the body of the container with a side handle, formed within the first recess, positioned perpendicularly to the longitudinal axis of the container. The container may include a second recess formed within the body of the container with a second handle formed within the second recess for enabling a user to lift the bottle and turn it upside down more easily. The second recess and its associated second handle may be formed along the body of the container or along the bottom of the container to enable the container to be pivoted (turned upside down) with little effort. The handles may be in the shape of an arc or a chord extending across the recessed regions or in the shape of a stub extending outwardly from the recessed region.

23 Claims, 6 Drawing Sheets

LIQUID CONTAINER WITH HANDLES

BACKGROUND OF THE INVENTION

This invention relates to containers for dispensing liquids (e.g., water) or solids, where the containers are normally lifted and then inverted in order to empty the container which may include mounting the container on top of a dispenser (e.g., a water cooler).

By way of example, containers for dispensing liquids may be water cooler bottles which typically are relatively large (bulky) and heavy. Such a bottle filled with five gallons of water may weigh more than 40 pounds, not counting the weight of the bottle. The containers (water bottles) generally have an elongated body with a closed bottom (base) and an opening at the top, opposite the base, for filling the container with liquid and for drawing the liquid out via the opening, when in use. The bottles are normally stored with their base on the ground or floor or in a box. A user must normally pick up the bottle from a storage area and then lift it up, invert it and place it onto the top of a dispenser (water cooler) with the liquid in the container flowing out of the opening into the dispenser. This is not an easy task to accomplish. Water cooler bottles generally do not have handles. This makes the picking up and inverting of the bottles very difficult, especially for individuals who are not particularly strong.

This is a significant problem as evidenced by numerous references discussing various means for carrying, lifting and turning these large bottles. By way of example, U.S. Pat. No. 5,954,216 titled Container With Integral Ergonomic Handle issued to Meisner et al shows the addition of a recessed handle to a water bottles. However, in Meisner et al. the recessed handle is either generally parallel to the major longitudinal axis of the bottle or at some angle close to 45 degrees with respect to the vertical. Although such an approach has some advantages, it puts much stress on the hand and wrist and is not suitable for those who do not have strong hands and/or wrists. Also, the patented scheme in so far as it pertains to an angled recessed handle is not adapted to enable lifting by both hands/arms of a user.

SUMMARY OF THE INVENTION

Accordingly it is an object of this invention to provide a container with at least one handle positioned such that the container, when filled, may be lifted without overly stressing the hand and/or wrists.

It is another object of the invention to provide a container with handles positioned such that the container may be lifted easily and such that it may subsequently be pivoted (turned upside down) with little effort.

In accordance with one embodiment of the invention, an elongated container includes at least one handle formed along the side of the container with the handle being generally perpendicular to the longitudinal axis of the container so a user's hand can be wrapped around the handle, with the palm and fingers either facing in the upward direction or facing in the downward direction. This enables a user to grip the handle in a manner most comfortable to the user and to bring into play the user's elbows and shoulders to pick up the container.

In the discussion to follow "bottles" may be used as a particular type of containers to illustrate the invention. Thus, a container, such as a water bottle, embodying the invention, may have a generally elongated (cylindrical) body with the elongated (cylindrical) body terminating at its bottom end into a base which is generally perpendicular to the longitudinal axis of the bottle and terminating at its top end into an annular tapering shoulder region with a cylindrical neck opposite the bottom and coaxial with the longitudinal axis with an opening in the neck for passing water into and out of the bottle. The bottle includes at least one recessed (cavity) region, integral to the bottle, located along and within the elongated (cylindrical) body with a side handle, integral to the bottle, extending across at least part of the recessed region, perpendicular to the longitudinal axis, for enabling a user's hand to be wrapped around the handle with the palm and fingers facing either up towards the neck or down towards the bottom of the bottle for selectively enabling the bottle to be lifted and inverted more easily. The outer surface of the side handle does not extend beyond the outer radius of the cylindrical body whereby there is no impediment to stacking the bottles one next to the other and/or one on top of the other.

Bottles (and/or containers) embodying the invention may include a second recessed (cavity) region formed along the bottom or the underside (base) of the bottle with a second handle formed across at least part of the second recessed region; and wherein a user may grip the side handle and use the second ("bottom") handle to pivot the bottle about the side handle. The second, or bottom, handle may extend along or within any recess formed along the bottom or the base of the bottle. The second handle may be formed along the bottom or the underside (base) of the bottle or it may be formed above the bottom of the bottle to enable the hand of a user to be passed around the "bottom" handle even when the bottle bottom is resting on a flat surface.

Bottles embodying the invention may include two "horizontal" side handles, opposite each other along the cylindrical body. These side handles may be formed in the upper region of the bottle at or near the shoulder region.

Containers embodying the invention do not need to have a cylindrical body. The body of containers embodying the invention may have the shape of a polygon (e.g., a rectangle, square, pentagon, hexagon, etc.).

BRIEF DESCRIPTION OF THE DRAWINGS

In the accompanying figures like reference characters denote like components.

DETAILED DESCRIPTION OF THE INVENTION

Figure 1:
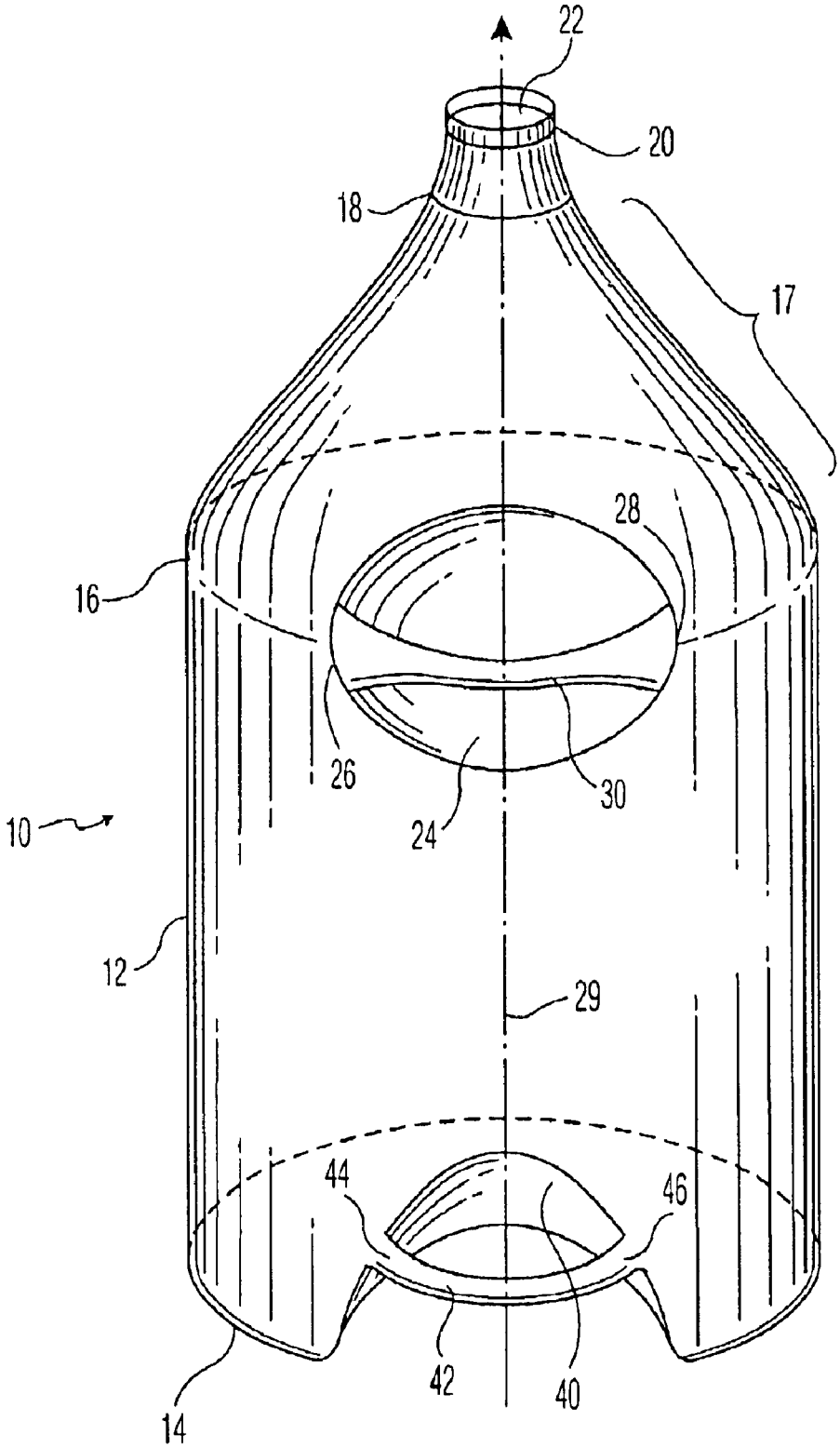
FIG. 1 is an isometric diagram of a bottle embodying the invention.

Referring to FIG. 1 there is shown a water bottle 10 embodying the invention. The water bottle 10 of FIG. 1 is designed to contain approximately 5 gallons of water, but it should be understood that bottles embodying the invention may be designed to contain more, or less, than this amount. The bottle 10 is preferably made of a suitable plastic but could also be made of glass or other materials. The bottle 10 of FIG. 1 has a cylindrical side wall 12 terminating at one end in a base 14. The underside of base 14 is the surface on which the bottle normally rests when it is not placed in a water cooler. The other (upper) end 16 of the cylindrical side wall 12 is attached to an annular shoulder region 17 which tapers gradually to a line 18 from which depends a generally cylindrical neck region 20. The neck region 20 has an opening 22 via which liquid is poured into the bottle and from which liquid flows into a water cooler (not shown) when the bottle 10 is inverted and the neck region 20 is inserted into a port of the water cooler and the shoulder region 17 rests on top of the water cooler.

In accordance with the present invention a cavity or recess 24 is formed in the bottle 10 at, or below, the upper end 16 of the cylindrical wall 12 where it joins to the shoulder region 17. A handle 30 is formed extending generally horizontally across the recess from one point 26 along the side wall 12 to another point 28 along the side wall 12. That is, the handle 30 lies in a plane which is generally perpendicular to the longitudinal axis 29 of the bottle 10, where the longitudinal axis 29 of the bottle runs between the base 10 and the top of the neck 20. The handle 30 is formed to enable a user to wrap the palm of his/her hand around the handle 30 so that the palm and fingers face up (toward the neck) or down (towards the base). As further discussed below this enables the user to more easily lift the bottle and to turn it so as to position the bottle 10 onto a water cooler.

Note that in FIGS. 1 and 1A the recess 24 extends partially above line 16 within the shoulder region 17 and partially below line 16 within the cylindrical portion of the body. In these two embodiments, the recess 24 and the "side" handle 30 are close to the top of the bottle and where the sloping shoulder 17 meets the cylindrical body 12. This structure enables a hand to be inserted around a handle 30 with the back of the hand and arm comfortably positioned proximal to the bottle. This structure also enables an individual to reach into a box and grab onto the handle 30 if the bottle is in a box and or closely surrounded by other bottles.

Figure 1A:
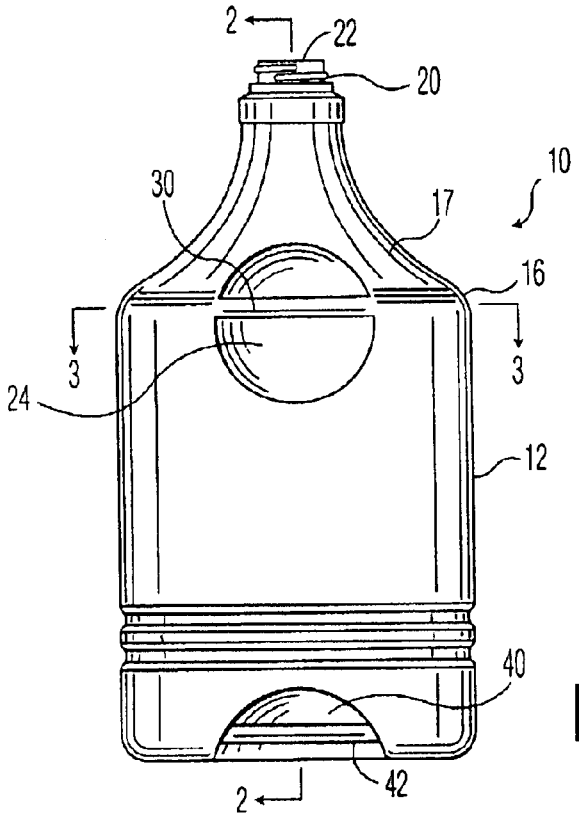
FIGS. 1A and 1D are diagrams of other bottles embodying the invention.
Figure 1B:
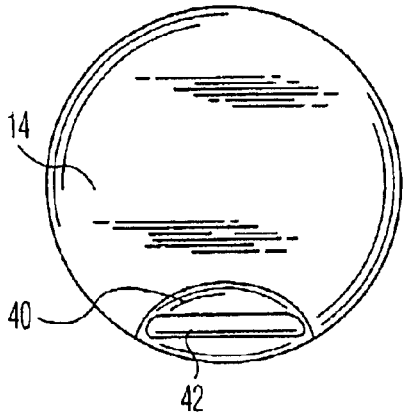
FIGS. 1B and 1C are bottom views of the underside of bottles embodying the invention illustrating different locations and positions for bottom handles.
Figure 1C:
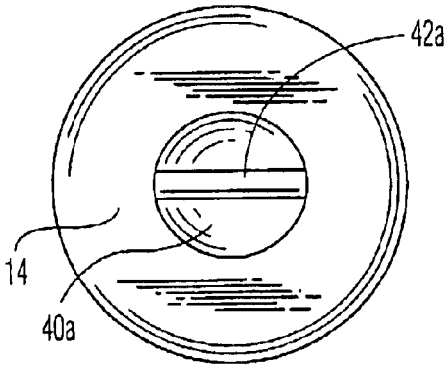
Figure 1D:
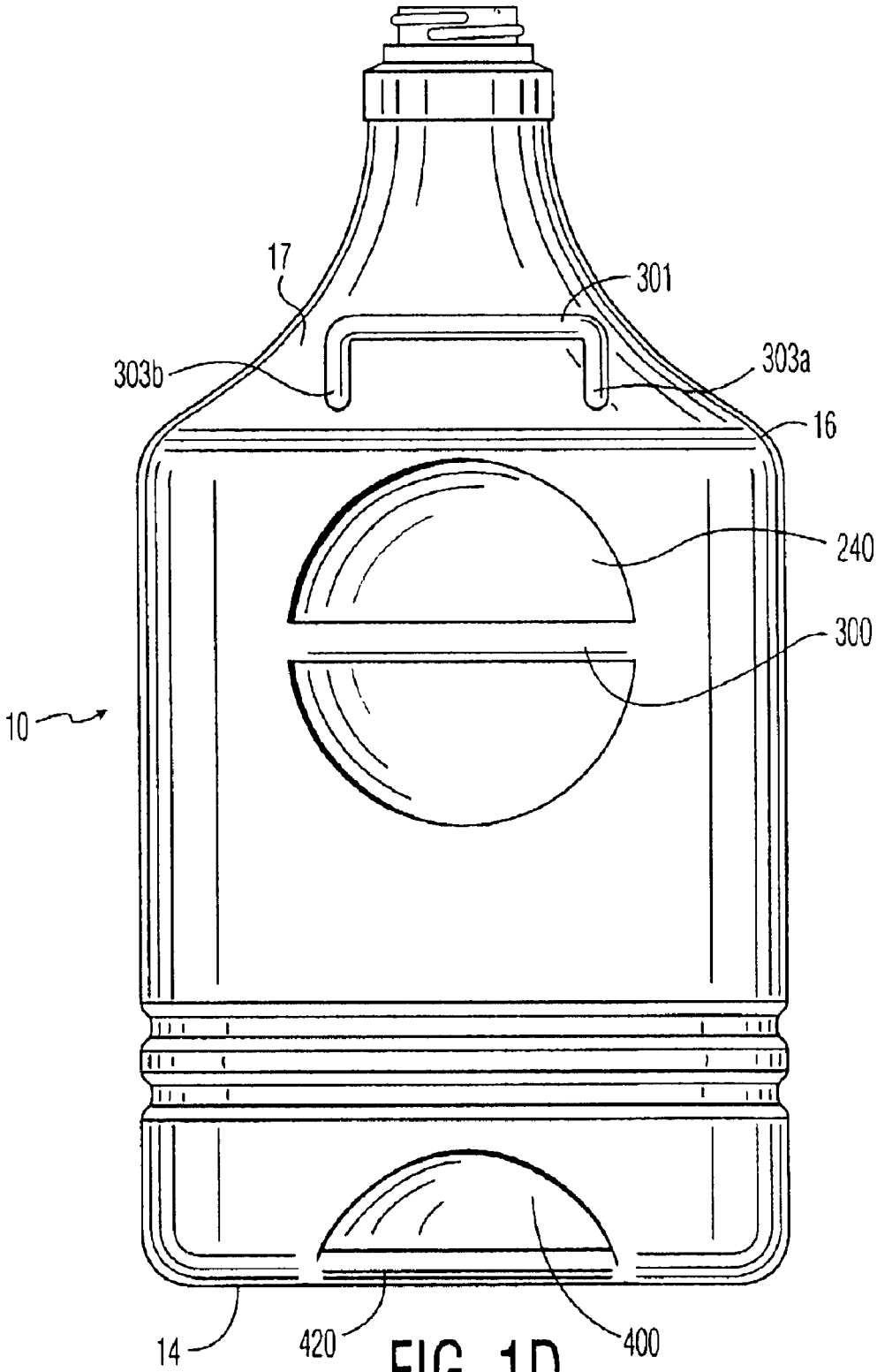

FIG. 1D shows a handle 301 extending upward in a generally vertical manner from the shoulder region 17. As for FIGS. 1 and 1A, the horizontal portion of the handle 301 lies in a plane perpendicular to the longitudinal axis of the bottle. Since the shoulder region 17 slopes underneath the handle 301, the region forms a "natural" recess (eliminating the need for a recess such as 24) so it is relatively easy for a user to wrap his/her hand around handle 301 to lift up the bottle, wherever the bottle may be located. It should be appreciated that the handle 301 may be hinged at or near contact points 303*a* and 303*b* with the shoulder region 17. The "hinging" of handle 301 enables it to be retracted so it lies against the body of the bottle when the bottle is not being carried.

FIG. 1D also illustrates that a recess 240 may be formed below the shoulder region 17 and line 16, along the cylindrical body with a handle 300 formed within or in front of the recess. As in FIGS. 1 and 1A, the handle 300 is formed so it is perpendicular to the longitudinal axis of the bottle. In FIG. 1D, the handle 300 is located at a lower point along the bottle than handles 30 in of FIGS. 1 and 1A. this is done to place the handle 300 closer to the center of gravity of the bottle when it is filled with a liquid in order to make the handling and the tilting of the bottle easier.

Except for handle 301, the handles and stubs (see FIG. 4) used to lift and/or tilt bottles embodying the invention are either flush with the outer surface of their respective bottles or recessed (set-back) from the outer surfaces. This feature (flush or recessed) of making the handles enables the bottles to be stacked when being transported. In addition, recessing the handles within the body makes it easier to lift a bottle when it is boxed or when surrounded with other bottles. It also functions to redistribute and rebalance the weight of the bottle making carrying and tilting of the bottle easier.

Referring back to FIG. 1, note that there is a bottom handle 42, in addition to side handle 30. In FIG. 1, a recess 40 is formed along the lower part of the cylindrical body 12, above the bottom surface 14. In FIG. 1, handle 42 is formed so as to extend along the outer surface of the body 12, generally parallel, to handle 30, and higher than the bottom 14 to allow a hand to pass underneath handle 42 when the bottom 14 of bottle 10 is resting on a flat surface. In FIG. 1, the recess region 40 appears as a semi-circular scooped out region with handle 42 continuing along the contour of the outer surface of cylindrical body 12.

FIG. 1A illustrates that a "bottom" handle 42 may be recessed (set-back) relative to the outer wall 12 of the bottle and be formed above the bottom surface 14. In FIG. 1D, a bottom handle 420 is shown to extend along the bottom surface of the bottle, with a recess 400 above the handle to permit the passage of a hand around the handle. The recess 400 may be a conic cut-out or extend along the full diameter (width) of the bottle.

As noted above, FIG. 1B shows that a recess 40 may be formed along a surface (or side) of a bottle (akin to a scoop) and that a bottom handle 42 may be offset or recessed from the outer surface. Alternatively, as shown in FIG. 1C, a bottom recess 40*a* may be formed in a center portion (symmetrically) of the bottom 14 of the bottle and the orientation of the bottom handle 42*a* may be made parallel to the orientation of the side handle 30 or perpendicular thereto for ease of handling the bottle and turning it over when filled with liquid. It should also be noted that recess 40*a* and handle 42*a* may be part of a bottom screw cap formed on the bottom of the bottle. The screw cap would then serve the functions of providing a bottom handle and, when needed, another opening for filling or emptying the bottle.

Figure 2:
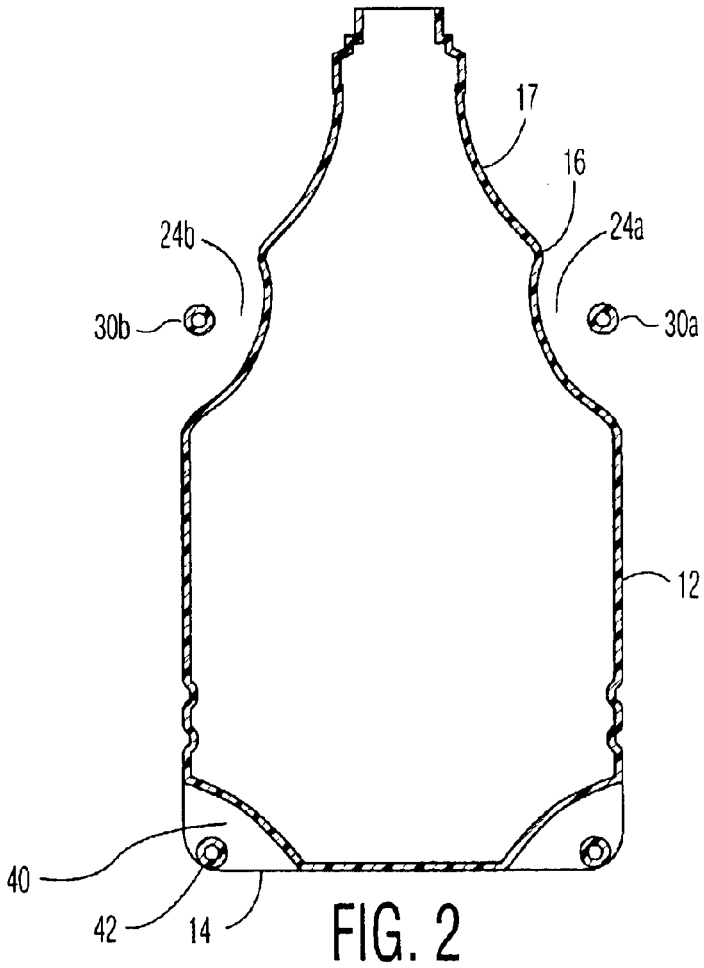
FIG. 2 is a cross-sectional diagram of a water bottle with two side handles embodying the invention.

Referring to FIG. 2 note that a pair of handles 30*a*, 30*b* may be formed in recesses 24*a*, 24*b*, which recesses are formed like recess 24, but opposite each other. For a cylindrical structure, recesses 24*a*, 24*b* would preferably be opposite each other. The two side handles 30*a*, 30*b*, in a plane perpendicular to the longitudinal axis of the bottle enable two hands to be used to lift the bottle. This makes it much easier for a person of limited strength to lift a bottle. Even more pronounced than in the case for a single horizontally running side handle, the two horizontally running handles (e.g., 30*a*, 30*b*) enable a user to lift a bottle without stressing or straining the user's wrists. Rather, the user can use his/her arms as levers about the elbows and/or pivot about the shoulders.

Referring to FIGS. 1, 1A, 1B, 1C, 1D and 2 note that a recess (e.g., 40 40*a*, or 400) may be formed in the base region of the bottle and a bottom handle (e.g., 42, 42*a*, 420) may be formed in a plane generally perpendicular to the longitudinal axis of the bottle. The bottom handle (e.g., 42, 42*a*, 420) may extend arc-like along the circumference of the bottle between points (e.g., 44 and 46 in FIG. 1) along the recess (e.g., 40) or it may be a chord within the recess which may be set back from the outer surface of the body. With respect to its elevation, a bottom handle (e.g., 42) may lie along the base (e.g., 14) underneath the bottle. Alternatively, the bottom handle may be raised above the base line and located higher up within the recess (e.g., 40) to provide space to enable a normal sized hand to grip the handle underneath or at the bottom of the bottle. The combination of one or more of the side handles (e.g., 30, 30*a*, 30*b*, 300, 301) and a base handle (e.g., 42) enables a user to lift the bottle 10 and invert it more easily than in prior art schemes. The side handles (e.g., 30, 30*a*, 30*b*, 300) may be positioned near the center of gravity of the bottle (when filled with water). The horizontal positioning of the side handles enables the bottle to be lifted easily and the side handles together with the base handle enable the bottle to be turned easily (pivoted) about the side handles so the bottle can be mounted on a water dispenser with less stress and strain than in the prior art schemes. Where two side handles are formed on a bottle, the two side handles may be formed to be horizontal relative to the long axis of the bottle and parallel to each other or one side handle may be formed to be horizontal and the other may be perpendicular to that handle. The side handles, as well as the bottom handle, may be solid or may be tubular to allow water (or any liquid or any substance within the bottle) to flow or pass through the handle.

Figure 3:
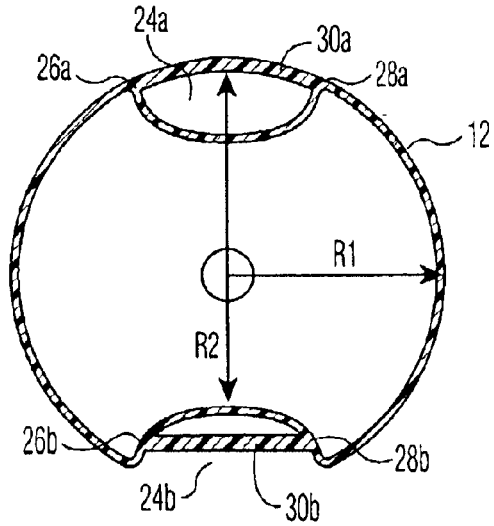
FIG. 3 is a top view of a section of a water bottle embodying the invention illustrating different positions for the side handles.

Refer now to FIG. 3 which shows a top view of the bottle with a slice taken through a bottle with two side handles. Where the outer radius of a cylindrical bottle is R1 and there is a recess 24*a* on one side and a recess 24*b* on the opposite side, handles 30*a* and 30*b* may be formed corresponding to these recesses. The handles (e.g., 30*a*, 30*b*) may be formed to be curved such that they are in line with, and continue, the outer surface of cylindrical body 12 as shown by 30*a*, which extends between points 26*a*, 28*a*, and conforms to the shape and contour of the cylindrical body. Alternatively, the handles may be a chord (i.e., a straight, linear, tube) extending between points 26*b* and 28*b* along the walls of a recessed region (e.g., 24*b*). Chord 30*b*, for example, lies between a radius R1 and a distance R2, where R1 is greater than R2, to ensure that the handle 30*b* does not extend beyond the outer circumference of the bottle.

Figure 4:
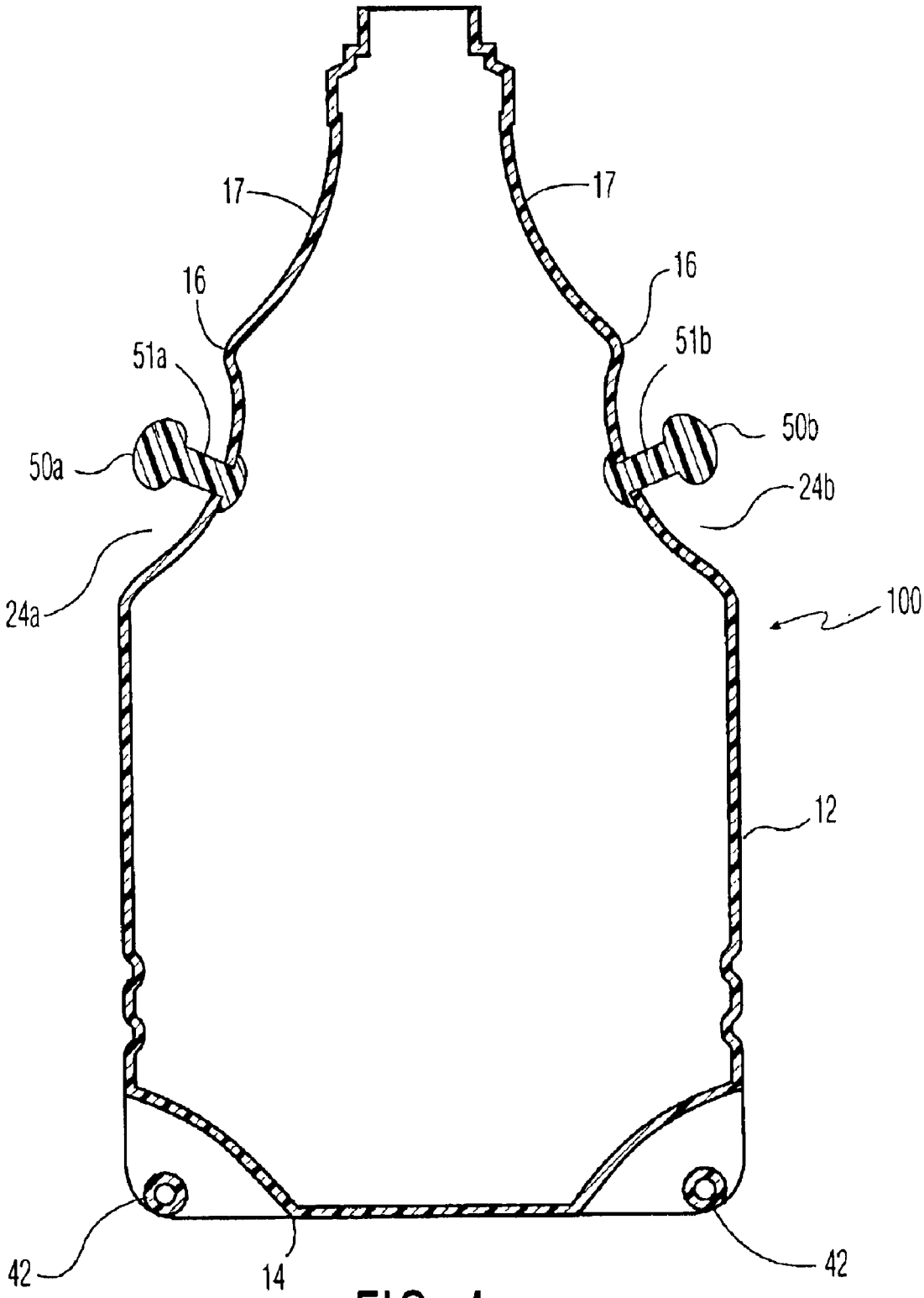
FIG. 4 is another embodiment of a water bottle embodying the invention.

Referring to FIG. 4, there is shown a bottle 100 embodying the invention in which instead of handles there is provided stubs or knobs 50*a*, 50*b*. The knobs 50*a*, 50*b* include shafts 51*a*, 51*b*, which extend outwardly from recessed wall regions 24*a*, 24*b*. The knobs 50*a*, 50*b* may be formed generally perpendicularly relative to the longitudinal axis of the bottle, or to have any suitable angle. In FIG. 4 the knobs are shown formed below the shoulder region. However it should be understood that the knobs may also be place along the shoulder region 17 above line 16. The knobs and associated shafts enable the bottle to be lifted and also function as pivoting elements to enable the bottle to be turned or tilted upside down easily. As shown in FIG. 4, base handles 42 may be formed on or within the bottom region of the bottle to enable the bottle to be turned in combination with one or more of the stubs 50*a*, 50*b*.

Figure 5:
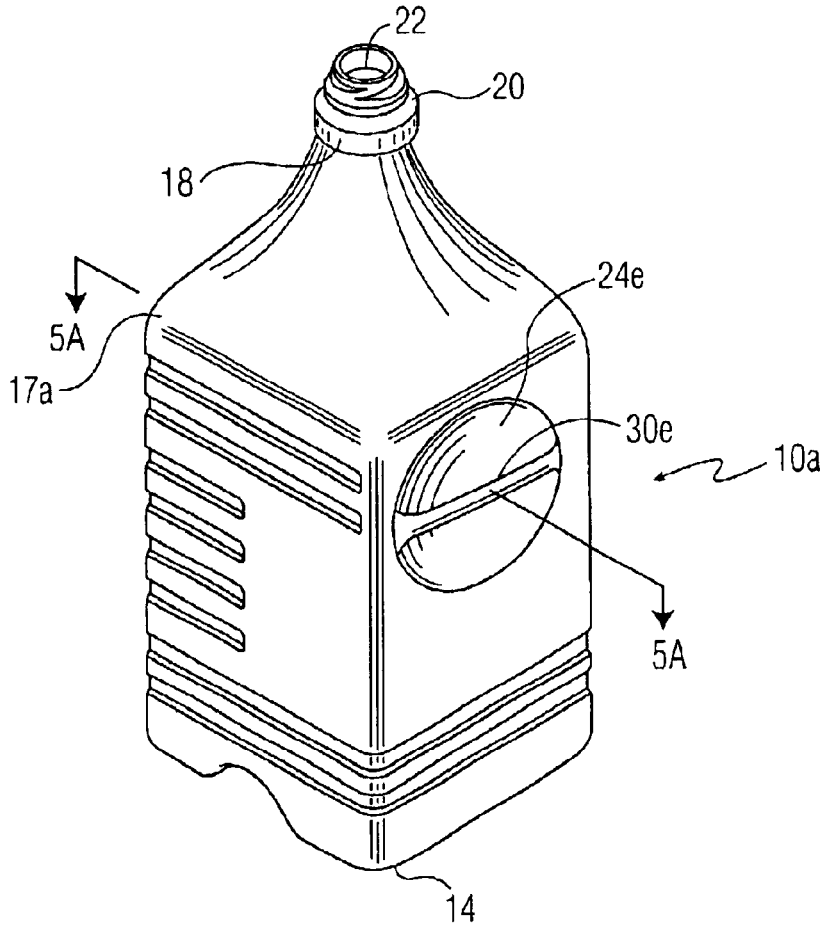
FIG. 5 is still another embodiment of the a water bottle embodying the invention.
Figure 5A:
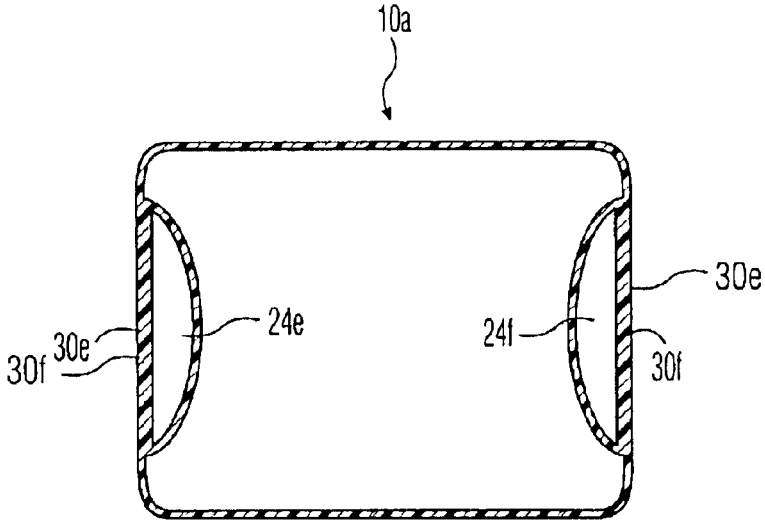
FIG. 5A is a cut-away top view of the bottle of FIG. 5 with two side handles.

FIGS. 5 and 5A show that the body of the bottle 10*a* may be rectangular (or square or have any polygonal shape) with one or more horizontal side handles formed along the sides, where the side handles lie in a plane perpendicular to the long direction of the sidewalls and the longitudinal axis of the bottle 10*a*. Recesses (24*e*, 24*f*) may be formed within the side walls and associated side handles (30*e*, 30*f*) are formed in line with side walls or within the recesses (24*e*, 24*f*) along the side walls. Generally the side handles are located nearer to the top shoulder region 17*a* than the base 14 of the bottle. The bottle 10*a* may also include a base handle along the bottom or underneath the bottle (not shown) so that the lifting and pivoting of the bottle about the horizontal side handles can be effectuated as for the cylindrical configurations.

Bottles have been used to illustrate the invention, but it should be understood that the inventive concepts apply to any container whether designed to dispense liquids or solids.

What is claimed is:

1. In combination with a container having a generally elongated body with the elongated body having, at one end thereof, a closed bottom generally perpendicular to the longitudinal axis of the container and having, at the other, top, end of the elongated body a cylindrical neck opposite the bottom and coaxial with the longitudinal axis, the improvement comprising:

at least one recessed region, integral to the container, located within the elongated body and a side handle, integral to the container, extending across at least part of the recessed region, said side handle being perpendicular to the longitudinal axis, for enabling a user's palm to be wrapped around the handle with the palm facing up towards the neck or down towards the bottom of the container for easing the lifting and turning of the container.

2. In the combination as claimed in claim 1 wherein the container has a generally cylindrical body with a bottom region terminating in said closed bottom and a top, and a tapering shoulder region extending from the top of the cylindrical body to the cylindrical neck; and wherein the improvement includes a recessed region partially located within the shoulder region and partially below the shoulder region, and wherein the side handle is located within the recessed region.

3. In the combination as claimed in claim 1 wherein the container has a cylindrical body and an annular tapering shoulder region extending from the top of the cylindrical body to the cylindrical neck; and wherein the improvement includes a handle extending vertically, like an inverted u-shaped member from the shoulder region.

4. In the combination as claimed in claim 1 wherein the improvement to the container also includes a second recessed region extending internally to the container from the outer surface of the container and a second, bottom, handle formed within the second recess and wherein the second handle lies in a plane parallel to the side handle.

5. In the combination as claimed in claim 1 wherein the improvement to the container also includes a second recessed region extending internally to the container along the bottom of the container and a second, bottom, handle formed within the second recess.

6. In the combination as claimed in claim 1 wherein the side handle comprises a stub extending from the outer surface of the recessed region.

7. In the combination as claimed in claim 6 wherein the stub extends in a generally perpendicular direction to the longitudinal axis of the container.

8. In the combination as claimed in claim 1 wherein the improvement to the container also includes a second recessed region extending internally to the container from the outer surface of the container, opposite the at least one recessed region and a second handle within the second recessed region opposite the side handle and also lying in a plane perpendicular to the longitudinal axis.

9. In the combination as claimed in claim 1 wherein the improvement to the container also includes a second recessed region extending internally to the container from the outer surface of the container, the second recessed region extending partly along the bottom of the elongated body and including the bottom of the container.

10. A container comprising:

a generally elongated body with the elongated body having, at one end thereof, a closed bottom generally perpendicular to the longitudinal axis of the container and having, at the other, top, end of the elongated body a cylindrical neck opposite the bottom and coaxial with the longitudinal axis;

first and second recessed regions, integral to the container, extending inwardly from the outer surface of the container, at least the first recessed region being formed along the elongated body of the container;

a first, side, handle, integral to the container, extending across at least part of the first recessed region, said first side handle being perpendicular to the longitudinal axis, for enabling a user's palm to be wrapped around the handle with the palm facing up towards the neck or down towards the bottom of the container;

a second handle extending across at least part of the second recessed region; and said first and second recessed regions and the respective handles formed therein being positioned relative to each other and the container to enable a user to more easily lift and turn the container upside down.

11. The container as claimed 10 wherein the first and second recessed regions are formed in line, one above the other, along the elongated body of the container and the first and second handles are also formed one above the other and generally parallel to each other for enabling a user to pivot the container about the first handle to more easily lift and turn the container.

12. The container as claimed 10 wherein the first recessed region is formed along the top region of the elongated body of the container and the second recessed region is formed along the bottom of the container.

13. The container as claimed in claim 10 wherein the first and second recessed regions and the first and second handles are formed opposite each other along the elongated body of the container.

14. The container as claimed in claim 10 wherein at least one of the side handles is a stub extending outwardly from the outer surface of the recessed region.

15. The container as claimed in claim 10 wherein the elongated body of the container is generally of cylindrical shape.

16. The container as claimed in claim 10 wherein the elongated body of the container is generally of rectangular shape.

17. The container as claimed in claim 10 wherein the second recessed region is formed along the closed bottom region of the container and the second handle is formed therein.

18. A container comprising:

a generally elongated body with the elongated body having, at one end thereof, a closed bottom generally perpendicular to the longitudinal axis of the container and having, at the other, top, end of the elongated body a cylindrical neck opposite the bottom and coaxial with the longitudinal axis;

a recessed region integral to the container, extending inwardly from the outer surface of the container, said recessed region being formed along the elongated body of the container; and a side handle, integral to the container, extending across at least part of the recessed region, said side handle being perpendicular to the longitudinal axis, for enabling a user's palm to be wrapped around the handle with the palm facing up towards the neck or down towards the bottom of the container in order to more easily lift the container.

19. The container as claimed in claim 18 wherein said recessed region is a first recessed region and said side handle is a first handle and further including a second recessed region also formed inwardly from the outer surface of the container and a second handle formed within the second recessed region for enabling a user to more easily lift and turn the container upside down.

20. The container as claimed in claim 18 wherein said elongated body includes an annular tapering shoulder extending from the top end of the elongated body to the cylindrical neck; and wherein there is a u-shaped handle extending from the tapering shoulder around which the palm of a user can be wrapped.

21. The container as claimed in claim 18, wherein the handle has one of the following shapes: an arc extending across at least part of the recessed region, a chord extending across at least part of the recessed region and a stub extending outwardly from the recessed region.

22. In combination with a container having a generally elongated (cylindrical) body with the elongated (cylindrical) body having, at one end thereof, a closed bottom generally perpendicular to the longitudinal axis of the container and having, at the other end of the elongated (cylindrical) body, an annular tapering shoulder region with a cylindrical neck opposite the bottom and coaxial with the longitudinal axis, the improvement comprising:

an inverted unshaped handle formed along the annular tapering shoulder region wherein the handle has a horizontal portion extending in a perpendicular plane relative to the longitudinal axis of the bottle and located along the tapering region for enabling a user's palm to be wrapped around the handle with the palm facing up towards the neck or down towards the bottom of the container for selectively easing the lifting and turning of the container.

23. In the combination as claimed in claim 22 wherein the handle is retractable whereby it is extended when the bottle is being carried and whereby it may be retracted to lie along the surface of the bottle when the bottle is not being carried.

* * * * *